US010480360B2

(12) United States Patent
Heilig et al.

(10) Patent No.: US 10,480,360 B2
(45) Date of Patent: Nov. 19, 2019

(54) CAM PHASER

(71) Applicant: ECO Holding 1 GmbH, Marktheidenfeld (DE)

(72) Inventors: Markus Heilig, Bonn (DE); Florian Hentsch, Gruibingen (DE); Dietmar Schulze, Muezenberg (DE)

(73) Assignee: ECO Holding 1 GmbH, Marktheidenfeld (DE)

( * ) Notice: Subject to any disclaimer, the term of this patent is extended or adjusted under 35 U.S.C. 154(b) by 0 days.

(21) Appl. No.: 15/864,114

(22) Filed: Jan. 8, 2018

(65) Prior Publication Data

US 2018/0135475 A1 May 17, 2018

Related U.S. Application Data

(63) Continuation of application No. PCT/EP2016/067660, filed on Jul. 25, 2016.

(30) Foreign Application Priority Data

Jul. 30, 2015 (DE) ..... 10 2015 112 442

(51) Int. Cl.
*F01L 1/34* (2006.01)
*F01L 1/344* (2006.01)

(52) U.S. Cl.
CPC ... *F01L 1/3442* (2013.01); *F01L 2001/34479* (2013.01); *F01L 2101/02* (2013.01); *F01L 2103/00* (2013.01); *F01L 2820/00* (2013.01)

(58) Field of Classification Search
CPC ..... F01L 1/3442; F01L 2001/34479; F01L 2101/02; F01L 2103/00; F01L 2820/00
See application file for complete search history.

(56) References Cited

U.S. PATENT DOCUMENTS 10,054,210 B2 * 8/2018 Hentsch ..... F01L 1/047

FOREIGN PATENT DOCUMENTS

| | | |
|---|---|---|
| DE | 102013107431 | 1/2015 |
| DE | 102013015677 A1 | 3/2015 |
| JP | H11182216 | 7/1999 |
| WO | WO2015000883 | 1/2015 |

* cited by examiner

*Primary Examiner* — Zelalem Eshete
(74) *Attorney, Agent, or Firm* — Von Rohrscheidt Patents

(57) ABSTRACT

A cam phaser including a stator that is driven by a crank shaft of an internal combustion engine; and a rotor that is connectable torque proof with a cam shaft of the internal combustion engine and that includes plural blades that protrude radially outward from a rotor hub, wherein operating chambers arranged between the stator and the rotor are divided into pressure cavities by the blades, wherein the stator and the rotor are configured as sintered components, wherein displacement recesses are provided on axially configured faces of the stator and/or of the rotor wherein material is configured to flow into the displacement recesses during a deforming finishing of the faces.

8 Claims, 5 Drawing Sheets

CAM PHASER

RELATED APPLICATIONS

This application is a continuation of International Application PCT/EP 2016/067660 which claims priority from German Patent Application DE 10 2015 112 442.4 filed on Jul. 30, 2015, both of which are incorporated in their entirety by this reference.

FIELD OF THE INVENTION

The invention relates to a cam phaser including a stator that is driven by a crank shaft of an internal combustion engine, a rotor that is connectable torque proof with a cam shaft of the internal combustion engine and that includes plural blades protruding radially outward from a rotor hub, wherein operating chambers arranged between the stator and the rotor that are divided into pressure cavities by the blades and wherein the stator and the rotor are configured as sintered components.

BACKGROUND OF THE INVENTION

Cam phasers are used modern internal combustion engines to optimize consumption and power parameters and are used for controlling opening and closing timing of the gas control valves in order to be able to variably configure a phase relationship between a crank shaft and a cam shaft in a defined angle range between a maximum early position and a maximum late position. For this purpose the cam phaser is integrated into a drive train through which torques are transmitted from the crank shaft onto the cam shaft. The cam phaser thus includes a stator that is driven by the crank shaft and a rotor that is connected torque proof with the cam shaft. Between the rotor and the stator operating cavities are provided that are loadable with a pressure medium and which are divided into counter acting pressure cavities by blades associated with the rotor. During operations of the internal combustion engine both pressure cavities are permanently filled with pressure medium, so that the rotor and the stator are connected with each other in a rather rigid manner. The timing of the gas control valves is adjusted by increasing a pressure in one of the pressure cavities while reducing a pressure in a respective other pressure cavity. Thus, the pressure medium has to be provided to a first pressure cavity and drained from a second pressure cavity towards a tank which adjusts an angular orientation between the cam shaft and the crank shaft.

In the art, in particular the components rotor and stator of the cam phaser are produced from steel or aluminum alloys by a sintering method. In order to provide a correct function of the cam phaser the process steps pressing, coarse machining and sintering are followed by rather complex finishing methods including e.g. calibrating, grinding, fine turning, etc. in order to assure a required parallel alignment of axially opposite surfaces. The finishing processes are expensive and have their quality risks which are only increased by handling steps arranged there between.

DE 10 2013 015 677 A1 provides a solution for the recited disadvantages through a method and a component replacement with two sinter joined components and a radial deformation element. The proposed multi component configuration of the stator or the rotor is considered detrimental due to the number of components and the complex joining method.

BRIEF SUMMARY OF THE INVENTION

Thus, it is an object of the invention to provide a cam phaser in which the precision required for the function of the cam phaser can be achieved with significantly reduced finishing complexity while maintaining cost effective production.

The object is achieved according to the invention in that displacement recesses are provided on axially configured faces of the stator and/or the rotor wherein material of the faces can flow into the displacement recesses during a deforming finishing process. Put differently defined recesses configured as cut outs or grooves are introduced during pressing of the blanks wherein the cut outs or grooves provide the displacement space for the finishing through deformation that is required after the sintering without impairing the load bearing capability of the machined faces so that sustainable surface pressures would be exceeded during operations.

The faces can advantageously be finished by height calibration. The height of the respective component as well as the parallel orientation of two opposite surfaces can thus be produced by an intentional plastic deformation of the sintered material in a simple and cost effective manner using a forming tool.

By providing the displacement recesses on the axial faces essentially evenly distributed it is possible according to an advantageous embodiment of the invention to avoid an impairment of the load bearing capability of the faces so that a predetermined surface pressure is not exceeded during operations of the cam phaser.

Advantageously the displacement recesses are configured three dimensional facet shaped and respectively include a base surface and essentially trapezoid side surfaces so that a respective circumferential bar structure envelops the displacement recesses. Thus, advantageously the bar structures form a calibration structure.

According to an advantageous embodiment of the invention the displacement recesses are arranged on the faces so that at least a portion of the bar structures forms a continuous structure which circumferentially defines the faces. This circumferential structure seals when the respective face contacts a corresponding surface of the cam phaser so that leakage can be significantly reduced.

Advantageously the calibration structure includes a surface portion that is adapted to a size of the sintered portion. The surface portion therefore is a function of the size of the stator or the rotor. Generally speaking the calibration structure forms a larger surface portion for smaller components than for larger components. Thus also for smaller components leakage can be advantageously reduced and the required displacement space can be advantageously provided. Furthermore additional deformation and thus an undesired height reduction of the components can be avoided during operations.

Surface ratios between the displacement recesses and the calibration structure substantially influence an achieved degree of deformation and thus precision with respect to achieving a particular height dimension. Since height calibrating loads the opposite surfaces with a pressing force and an opposite retaining force a substantial degree of elastic deformation is achieved in addition to the intended plastic deformation, wherein the elastic deformation leads to a spring back of the deformed material portions when the component is unloaded. The elastic portion has be kept small since it is a parameter that is very difficult to control during subsequent clamping of the component in the cam phaser which can then have negative effects. Since the elastic deformation portion cannot be totally avoided during these fabrication methods the elastic deformation portion is brought to a low and controllable level through a suitable configuration of the surface structure according to the invention which is performed for example by controlled shaping of the transitions like shoulders and radii etc.

In order to keep the elastic portion as small as possible an inclination angle of the trapezoid side surfaces can be adapted to the surface portion of the calibration structure. As a matter of principle it has become apparent that a transition between protruding portions and recessed portions have to be provided steeper when the portion of the recessed surface (displacement recesses) become smaller and vice versa.

BRIEF DESCRIPTION OF THE DRAWINGS

Further advantages can be derived from the dependent patent claims, the description and the drawing figure, wherein:

DETAILED DESCRIPTION OF THE INVENTION

Figure 1:
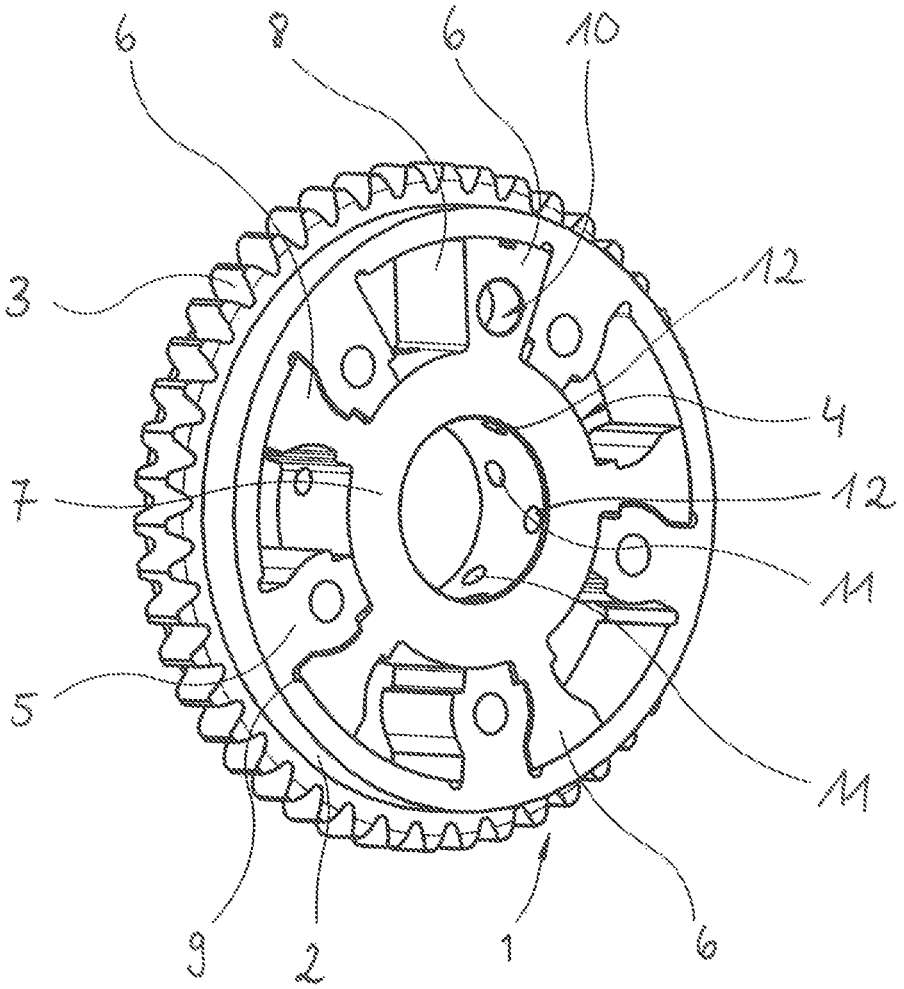
FIG. 1 illustrates a stator and a rotor of a known cam phaser in a perspective view.

FIG. 1 illustrates a known cam phaser 1 configured to adjust an angular relationship between a crank shaft and a cam shaft during operations of an internal combustion engine. A relative rotation of the non-illustrated cam shaft adjusts opening and closing timing of the gas control valves so that the internal combustion engine delivers optimum power at a respective speed. The cam phaser 1 thus facilitates a continuously variable adjustment of the cam shaft relative to the crank shaft.

The cam phaser 1 includes a cylindrical stator 2 which is connected torque proof with a gear 3. In the embodiment the gear 3 is a sprocket over which a chain is run that is not illustrated in detail. The gear 3, however, can also be a timing belt cog over which a drive belt is run that forms the drive element. The stator 2 is operatively connected with the crank shaft through the drive element and the gear 3 in a known manner.

In this embodiment the stator 2 and the gear 3 are integrally configured in one piece. Bolts clamp a non-illustrated stator cover against a unit formed by the stator 2 and the gear 3. When the stator 2 and the gear 3 are separate components in an alternative embodiment the stator 2 is clamped by bolts between the gear 3 and a stator cover.

The stator 2 is provided with radially inward protruding bars 5. Blades 6 of a rotor 4 are arranged circumferentially between the bars 5. The rotor 4 includes a rotor hub 7 which is connected torque proof with the cam shaft. Thus, the rotor hub 7 is shrunk or pressed onto a cam shaft end. In order to adjust the angular relationship between the cam shaft and the crank shaft the rotor 4 is rotated relative to the stator 2 against the force of a spiral spring. Thus, depending on the intended direction of rotation the hydraulic fluid is pressurized in pressure chambers 8 that are associated with a first direction of rotation whereas the pressure chambers 9 associated with a second direction of rotation are unloaded towards the tank. The pressure chambers 9 associated with the other direction of rotation are illustrated in the drawing figure in their minimum condition.

In order for the rotor 4 to take an early outlet cam shaft position that is required for engine start when the internal combustion engine is turned off, this means when the cam phaser 1 is unloaded the rotor 4 is rotated by the spiral spring into a starting position. In this starting position the rotor 4 is fixed against pivoting relative to the stator 2 by a locking device 10. The locking device is arranged in one of the blades 6. Thus, during a pressure drop in the pressure cavities 8, 9 a non-illustrated locking bolt is moved by the spring force of a compression coil spring that is not illustrated in more detail into a locking position in which the locking bolt engages a locking opening of the non-illustrated stator cover. Upon engine start up the locking bolt is loaded by the hydraulic fluid against the spring force and pushed back so that the rotor 4 is unlocked from the stator cover and the cam phaser 1 can move into its control position.

The pressure chambers 8, 9 can be supplied with hydraulic fluid through transversal bore holes 11, 12 or the hydraulic fluid can be drained from the pressure chambers. Thus, a hydraulic valve is provided coaxially arranged within the cam shaft wherein the hydraulic valve includes at least one hydraulic piston.

The stator 2 and the rotor 4 of the cam phaser 1 are typically made from a steel or aluminum alloy and produced by a sintering method. In order to provide a correct function of the cam phaser 1 the process steps pressing, coarse machining and sintering are followed by rather complex finishing methods including calibrating, grinding, fine turning etc. in order to assure a required parallel alignment of axially opposed surfaces. These finishing processes are expensive and bear quality risks which are even increased by intermediate handling steps.

In order to provide a cam phaser 1 where a precision of the sintered components required for functionality can be achieved with significantly reduced finishing complexity while maintaining a cost effective manufacture the cam phaser 1 according to the invention includes displacement recesses 14 on axially configured faces of the stator and/or the rotor 4.

Figure 2:
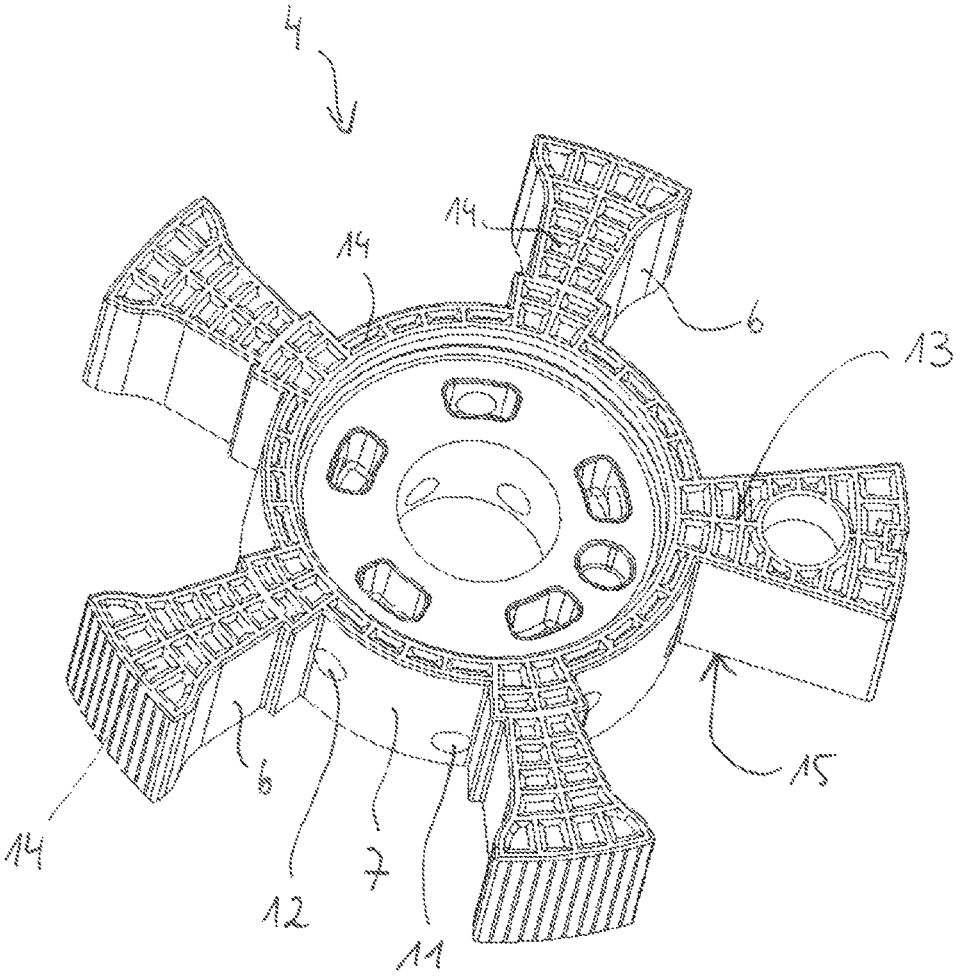
FIG. 2 illustrates a rotor of the cam phaser according to the invention in a perspective view.

FIG. 2 illustrates a rotor 4 of a first embodiment of a cam phaser 1 according to the invention. Faces 13, 15 which contact an inner surface of the stator 2 after assembling the cam phaser 1 include displacement recesses 14 into which the material of the rotor 4 can flow during a deforming finishing process of the faces 13, 15. The finishing is advantageously performed by height calibration during which the height of the respective component and the parallel orientation of two opposite surfaces can be provided in a simpler and more cost effective manner through an intentional plastic deformation of the sintered material using a forming tool.

During pressing of the blanks defined recesses are introduced in the form of recesses or grooves which provide the displacement space that is required for the finishing through deformation that is necessary after the sintering without impairing a load bearing capability of the finished faces 13, 15 so that sustainable surface pressures are exceeded during operations.

Since the displacement recesses 14 are essentially evenly distributed on the axial faces 13, 15 it is possible to avoid an impairment of the load bearing capability of the faces 13, 15 so that a predetermined surface pressure is not exceeded during operations of the cam phaser 1.

Figure 4:
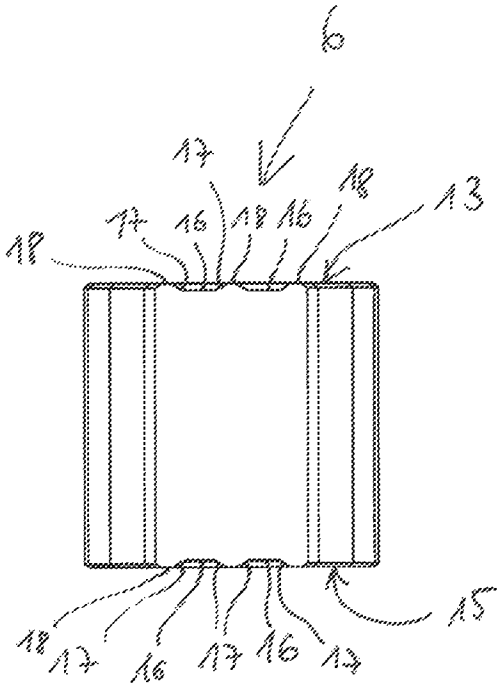
FIG. 4 illustrates a top view of the blade according to FIG. 3.
Figure 3:
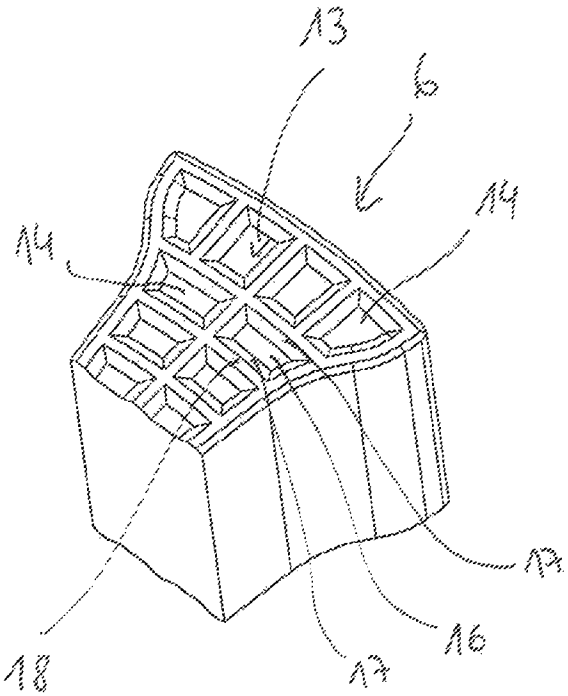
FIG. 3 illustrates a blade of the rotor according to FIG. 2 in a partial sectional view and in a perspective view.

As evident in particular from FIGS. 3 and 4 which illustrate blown up details of a blade 6 the displacement recesses 14 are configured three dimensional facet shaped and respectively include a base surface 16 and essentially trapezoid side surfaces 17 so that a respective circumferential bar structure 18 envelops the displacement recesses 14. Thus, adjacent displacement recesses 14 transition into the same bar structure 18. The bar structures 18 essentially have an identical width over the faces 13, 15. The entirety of the bar structures 18 forms a calibration structure which includes a surface portion that is adapted to the size of the component. Thus, an additional deformation and thus an unintentional height reduction of the components during operations can be prevented. Thus, the surface portion is defined so that the required displacement space is provided and a desired sealing can be simultaneously provided.

The surface ratios between the displacement recesses and the calibration structure substantially contributes to the degree of deformation achieved and thus the precision with respect to obtaining a particular height dimension. Since height calibration loads the opposite surfaces with a pressing force and a counter acting support force a substantial amount of elastic deformation is achieved in addition to the intended plastic deformation wherein the elastic deformation leads to a spring back of the deformed material portions during unloading of the component. This elastic portion has to be kept small since it is a parameter that is difficult to control during subsequent clamping of the component in the cam phaser 1 and can thus have negative consequences for the cam phaser. However, since the elastic deformation portion during calibration cannot be completely avoided with these fabrication methods the elastic deformation portion is brought to a low and manageable level by a suitable configuration of the surface structure according to the invention. This is achieved by the shaping of the displacement recesses 14 with the side surfaces 17 as a transition to the bar structures 18 described supra. Additional shape configuration can be provided by radii, etc.

In order to keep the elastic portion as small as possible the inclination angle of the trapezoid side surfaces 17 is adapted to the surface portion of the bar structures 18. As a matter of principle it has become apparent that transitions between protruding and recessed portions have to be steeper for a decreasing portion of recessed surfaces, i.e. displacement recesses 14 and vice versa.

Furthermore it is in particular evident from FIG. 2 that the displacement recesses 14 and the bar structures 18 are arranged on the faces 13, 15 so that a portion of the bar structures 18 forms a continuous structure which circumferentially defines the faces 13, 15. This circumferential structure facilitates safe sealing of the faces 13, 15 when they contact the inner surface of the stator 2 so that leakage can be significantly reduced. This portion of the bar structures 18 can be configured wider than the inner bar structures 18 in order to improve the sealing.

Figure 5:
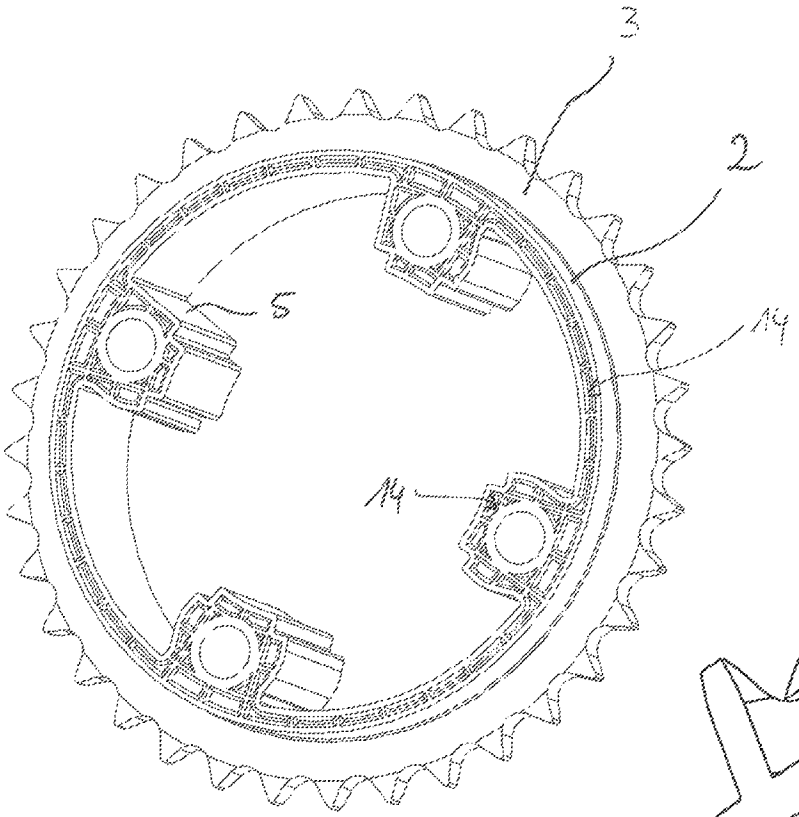
FIG. 5 illustrates a stator of a cam phaser according to the invention in a perspective view.
Figure 6:
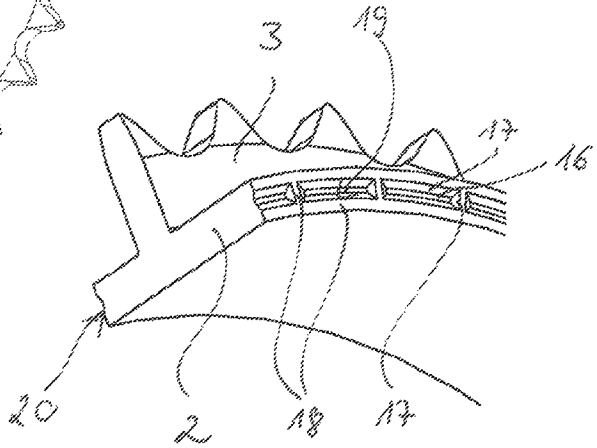
FIG. 6 illustrates an enlarged partial view of the stator according to FIG. 5.

FIGS. 5 and 6 illustrate a stator 2 according to the first embodiment which is integrally configured with a gear 3 according to FIG. 1. As already described with respect to the rotor 4 also the stator 2 includes the displacement recesses 14 described supra at its faces 19, 20. Reference is made to the descriptions provided supra.

Figure 7:
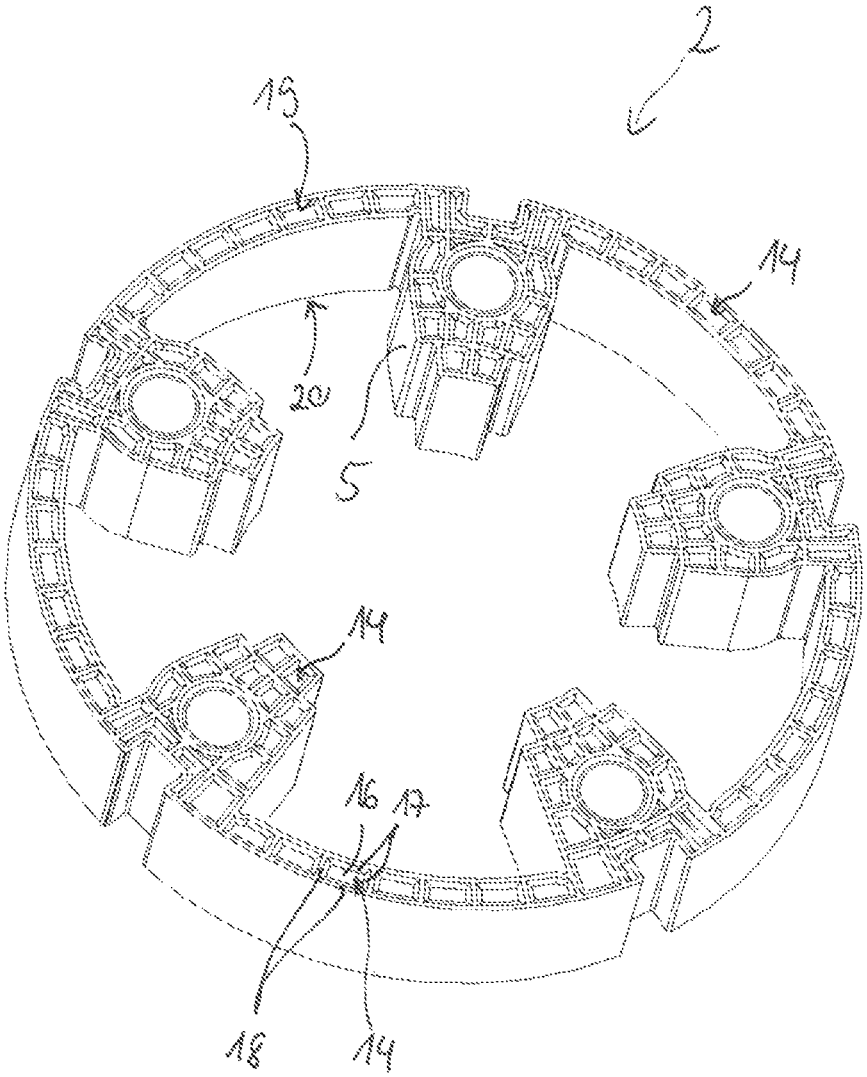
FIG. 7 illustrates a stator according to another embodiment of the cam phaser according to the invention in a perspective view.

FIG. 7 illustrates a stator 2 according to another embodiment wherein a timing belt cog or a belt pulley is attachable at the stator 2 torque proof.

The described calibration structure with the displacement recesses 14 can be provided according to the invention at the rotor 4 or at the stator 2 or at both components, however it is used in particular advantageously at the faces 19, 20 of the stator 2. Thus, it has to be considered when configuring the calibration structure that the maximum sustainable surface pressures do not have to be exceeded in an assembled condition as well as under any operating condition in order to be able to receive the axial clamping forces reliably and permanently without the clamping interconnection settling. The operating conditions thus include in particular high temperatures where the creeping resistance of the materials deteriorates and axial and in particular radial mechanical forces can impart additional axial force components upon the surface that is structured according to the invention.

It is also very important for the subsequent function of the components 2, 4 of the cam phaser 1 produced according to the invention that the axially opposed surfaces have the tightest tolerances with respect to parallel orientation. Thus it is even more important to precisely determine when configuring the calibration structure according to the invention on both faces 13, 15 or 19, 20 which deformation portions of a plastic nature or an elastic nature are to be expected and thus also to consider the force impact and the process impacts during calibration.

Other advantages of the calibration structure according to the invention are achieved in that the height calibrated faces 13, 15 or 19, 20 can be configured with a predetermined global topology which e.g. facilitates the deformation of a rotor 4 that is being clamped onto the cam shaft end and which can contribute to an additional functional improvement while simultaneously reducing productions cost.

REFERENCE NUMERALS AND DESIGNATIONS

1 cam phaser
2 stator
3 gear
4 rotor
5 bar
6 blade
7 rotor hub
8 pressure chamber
9 pressure chamber
10 locking device
11 transversal bore hole
12 transversal bore hole
13 face
14 displacement recess
15 face
16 base surface
17 side surface
18 bar structure
19 face
20 face

What is claimed is:

1. A cam phaser, comprising:

a stator that is driven by a crank shaft of an internal combustion engine; and a rotor that is connectable torque proof with a cam shaft of the internal combustion engine and that includes plural blades that protrude radially outward from a rotor hub, wherein operating chambers arranged between the stator and the rotor are divided into pressure cavities by the blades, wherein the stator and the rotor are configured as sintered components, wherein displacement recesses are provided on axially configured faces of the stator or the rotor wherein material is configured to flow into the displacement recesses during a deforming finishing of the axially configured faces.

2. The cam phaser according to claim 1, wherein the axially configured faces are finishable by height calibration.

3. The cam phaser according to claim 2, wherein the displacement recesses are substantially evenly distributed on the axially configured faces.

4. The cam phaser according to claim 2, wherein the displacement recesses are configured three dimensional facet shaped and respectively include a base surface and essentially trapezoid side surfaces so that circumferential bar structures envelop the displacement recesses.

5. The cam phaser according to claim 4, wherein the circumferential bar structures form a calibration structure.

6. The cam phaser according to claim 5, wherein the displacement recesses are arranged on the axially configured faces so that at least a portion of the bar structures forms a continuous structure which defines the axially configured faces circumferentially.

7. The cam phaser according to claim 5, wherein the calibration structure includes a surface portion that is adapted to a size of the sintered components.

8. The cam phaser according to claim 5, wherein an inclination angle of the trapezoid side surfaces is adapted to the surface portion of the calibration structure.

* * * * *